US005150811A

United States Patent [19]

Kelston

[11] Patent Number: 5,150,811

[45] Date of Patent: Sep. 29, 1992

[54] SQUEEZE RESISTANT CARTON HOLDER

[76] Inventor: Henry J. Kelston, 23 Clinton Ave., Nyack, N.Y. 10960

[21] Appl. No.: 771,844

[22] Filed: Oct. 3, 1991

Related U.S. Application Data

[63] Continuation of Ser. No. 708,153, May 13, 1991, which is a continuation of Ser. No. 594,508, Oct. 9, 1990, abandoned, which is a continuation of Ser. No. 444,918, Dec. 4, 1989, abandoned, which is a continuation of Ser. No. 162,925, Mar. 2, 1988, abandoned.

[51] Int. Cl.[5] ..... B65D 6/00

[52] U.S. Cl. ..... 220/411; 220/710; 220/740; 220/737; 206/217; 222/93; 222/105

[58] Field of Search ..... 206/217, 446, 485; 222/93, 105, 142.5, 183; 220/710, 705, 711, 712, 713, 740, 737, 402, 403, 410, 411, 740

[56] References Cited

U.S. PATENT DOCUMENTS

| | | | |
|---|---|---|---|
| 979,072 | 12/1910 | Javins . | |
| 1,863,853 | 6/1932 | Jackson . | |
| 1,927,258 | 9/1933 | Dailey . | |
| 2,501,653 | 3/1950 | Boak . | |
| 3,176,879 | 4/1965 | Mojonnier | 220/4 E |
| 3,255,932 | 6/1966 | Hunter et al. | 222/183 |
| 3,372,832 | 3/1968 | Yeater et al. | 220/90.4 |
| 3,380,608 | 4/1968 | Morbeck | 220/4 G |
| 3,874,554 | 4/1975 | Chang | 206/217 |
| 4,974,744 | 12/1990 | Shankkunyal | 220/740 |

FOREIGN PATENT DOCUMENTS

| | | | |
|---|---|---|---|
| 2746865 | 4/1979 | Fed. Rep. of Germany | 220/403 |
| 924790 | 3/1947 | France | 206/217 |

*Primary Examiner*—Joseph Man-Fu Moy
*Attorney, Agent, or Firm*—Philip Furgang

[57] ABSTRACT

The present invention teaches a squeeze resistant juice-type carton holder which is capable of resealing the contents thereof, and which will withstand normal finger pressures of a user which might squeeze fluid from the carton. An internally ribbed housing structure provides the stiffness required, and a straw holder permits storing of the carton straw for repeated use where desired. A housing comprises two halves which are hinged by means of a living hinge at one seam, and which may be locked by means of locking tabs.

21 Claims, 3 Drawing Sheets

SQUEEZE RESISTANT CARTON HOLDER

This is a continuation of copending application Ser. No. 07/708,153 filed on May 13, 1991 which is a continuation of Ser. No. 07/594,508 filed Oct. 9, 1990, now abandoned; which is a continuation of Ser. No. 07/444,918 filed Dec. 4, 1989, now abandoned; which is a continuation of Ser. No. 07/162,925 filed Mar. 2, 1988, now abandoned.

BACKGROUND OF THE INVENTION

The present invention relates to liquid containers of the type in which juice is sold, and more particularly to a squeeze resistant carton holder.

Many of us have witnessed children attempt to drink from one of the recently more popular "juice boxes" or small portable cartons in which juice, punch and other potable liquids are sold in supermarkets and other stores. First, a straw which is often taped to a side of the juice box is relatively easily removed and one end is pushed through a foil covering a hole in the top of the box. Once the foil is pierced, the fun (or problem) begins.

It seems as though children are never dressed in colors corresponding to the stain-causing colors of the punch or juice in the juice box from which they are drinking. It also never seems to fail that a child drinking from a juice box is sitting or standing on a car seat or carpet which is least resistant to spills. Old Faithful is reproduced in front of our eyes and, no matter what steps are taken—verbal or physical—the most that parents are usually able to come away with after watching kids drink from juice boxes is a slight elevation of their blood pressure.

It is to these parents that the present invention is at least in part directed. Imagine being able to place a juice box within a squeeze resistant holder which is sealable and resealable as well. Clearly, a need has existed for such a "system" or device for years now.

SUMMARY OF THE INVENTION

Accordingly, it is an object of the present invention to provide a squeeze resistant holder for what are sometimes referred to as juice boxes, such that normally applied pressures to the sides of the juice box of the type applied by children when drinking from them do not reach the confines of the carton.

A further object of the present invention is to provide such a holder which includes means for sealing and resealing the carton, thereby permitting spill-free saving of unfinished contents for a later time, and also savings in monies otherwise necessary for a newly opened container.

Another object of this invention is to provide such a holding system which provides child resistant locking means capable of securely holding a container therein.

Yet another object is to provide such a holding system, which includes means for holding a straw in an accessible position during periods between access to the container.

Another object of the present invention is to provide a container holding system, which enables resealing of the container being held.

Yet a further object is to provide such a container holding system, wherein crossing internal ribs provide rigidity and resistance to finger pressures on the sides thereof.

Still a further object is to provide such a system wherein a living-type hinge permits molding the entire structure in a single cavity.

Further objects of the present invention and its features will suggest themselves to those skilled in the art upon a reading of the present specifications, together with the drawings annexed hereto wherein, throughout the several views, similar reference characters denote similar elements, and wherein:

DETAILED DESCRIPTION OF THE INVENTION

Figure 1:
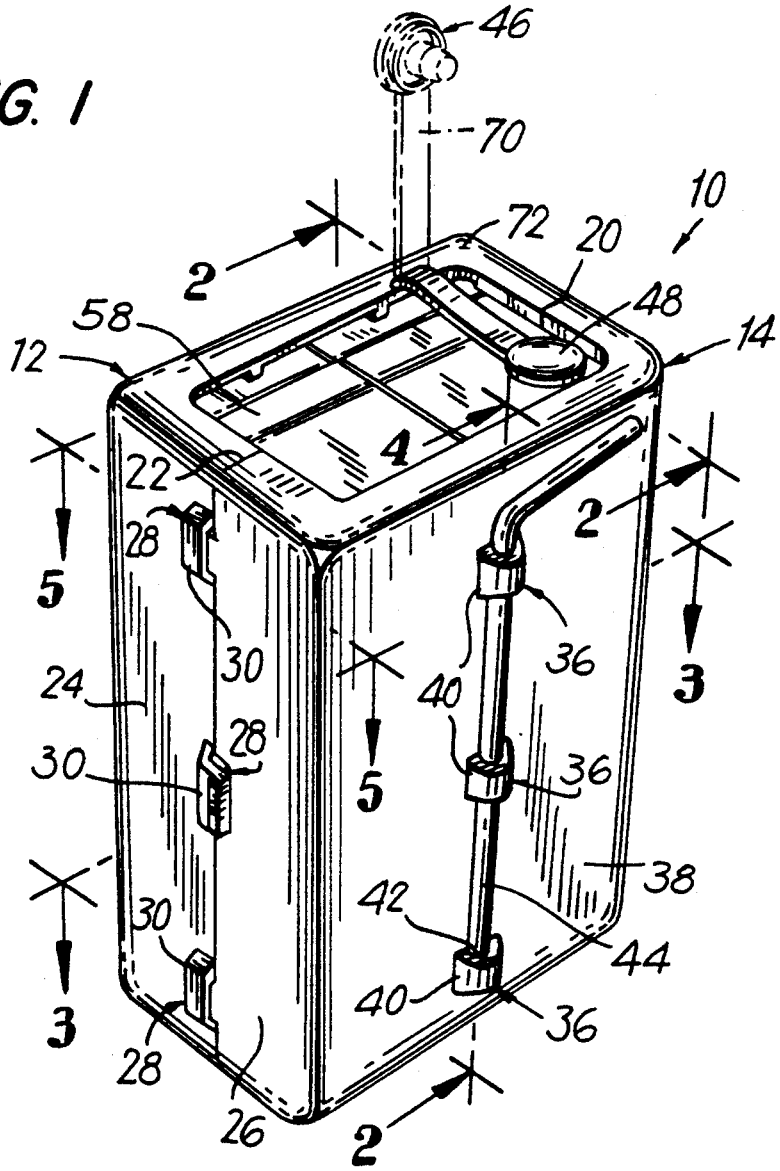
FIG. 1 is an upper left perspective view of the squeeze resistant carton holder system according to the present invention.

Referring now in more detail to the drawings, FIG. 1 illustrates a combination of elements which will herein sometimes be referred to as a "system" 10 which comprises a housing 12. In the preferred embodiment of the present invention illustrated in the drawings, housing 12 is formed of plastic by injection molding techniques or other suitable plastic manufacturing processes, and includes two halves 14 and 16.

Halves 14 and 16 are joined along a pivotal axis by what is known as a "living hinge" 18 comprising a relatively thin web of housing material continuous and integral with halves 14 and 16. Thus, living hinge 18 borders a seam 20 between the halves 14 and 16 at one side of the housing. At the opposite side of housing 12, the halves are separable from one another along a second seam 22 which defines the interface between the separable halves. At this separation interface, what have been designated as housing portions 24 and 26 are engaged by the user's fingers (thumbs) and are simply drawn apart in a manner which simulates the characteristics of a valise.

Figure 3:
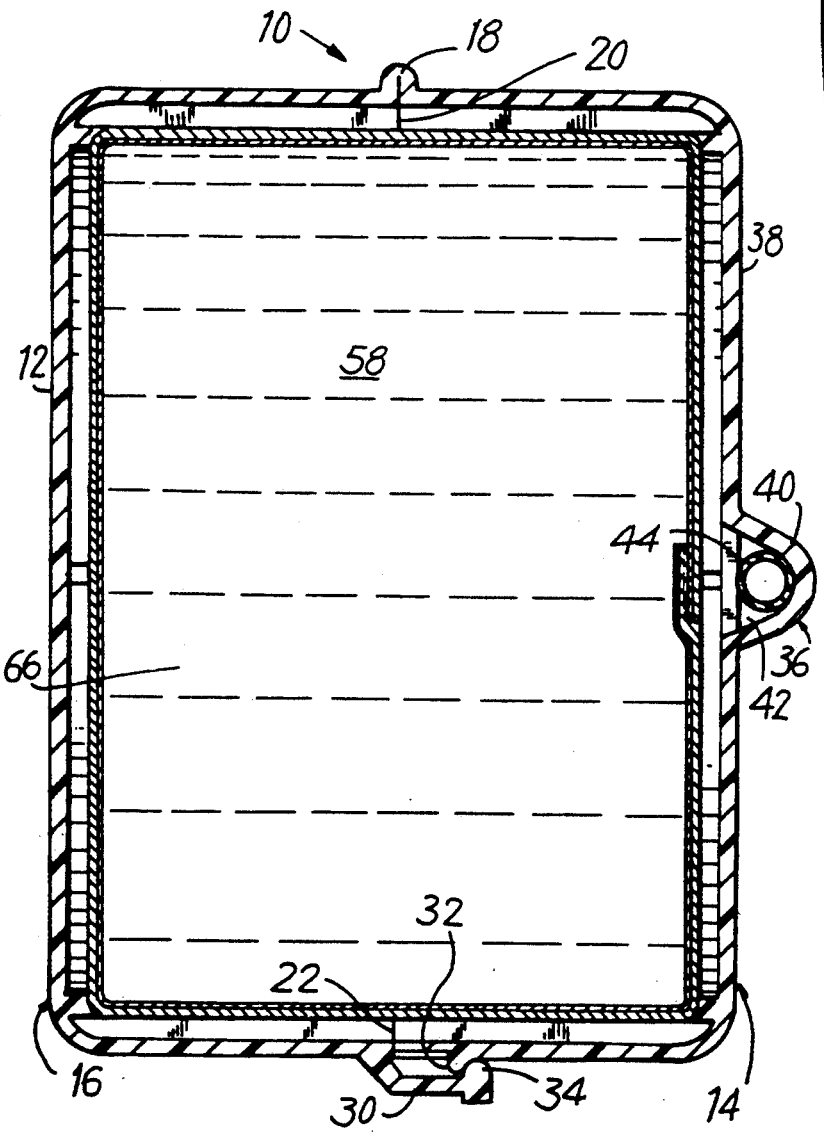
FIG. 3 is a sectional plan view taken along the line 3—3 of FIG. 1.
Figure 4:
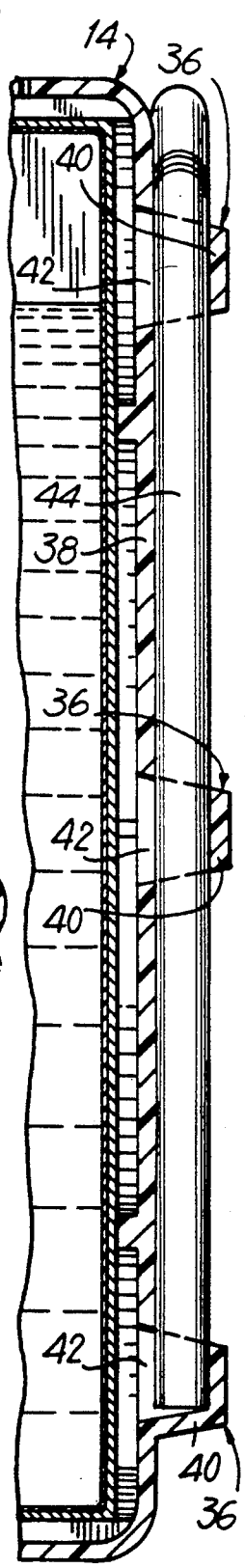
FIG. 4 is a sectional elevational view taken along the line 4—4 of FIG. 1.
Figure 5:
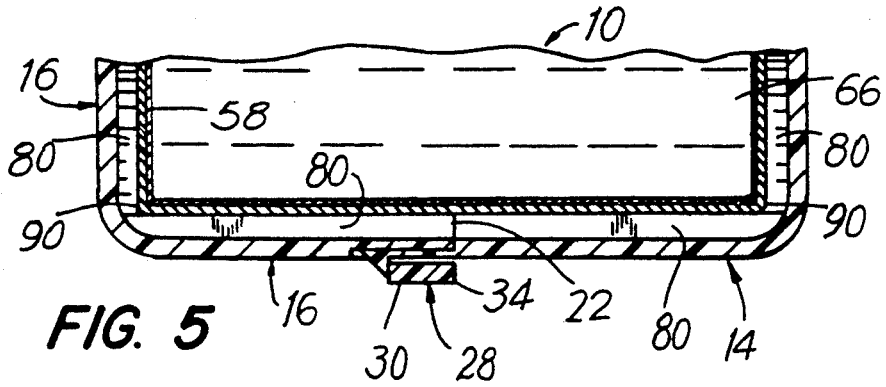
FIG. 5 is a sectional plan view taken along the line 5—5 of FIG. 1.
Figure 6:
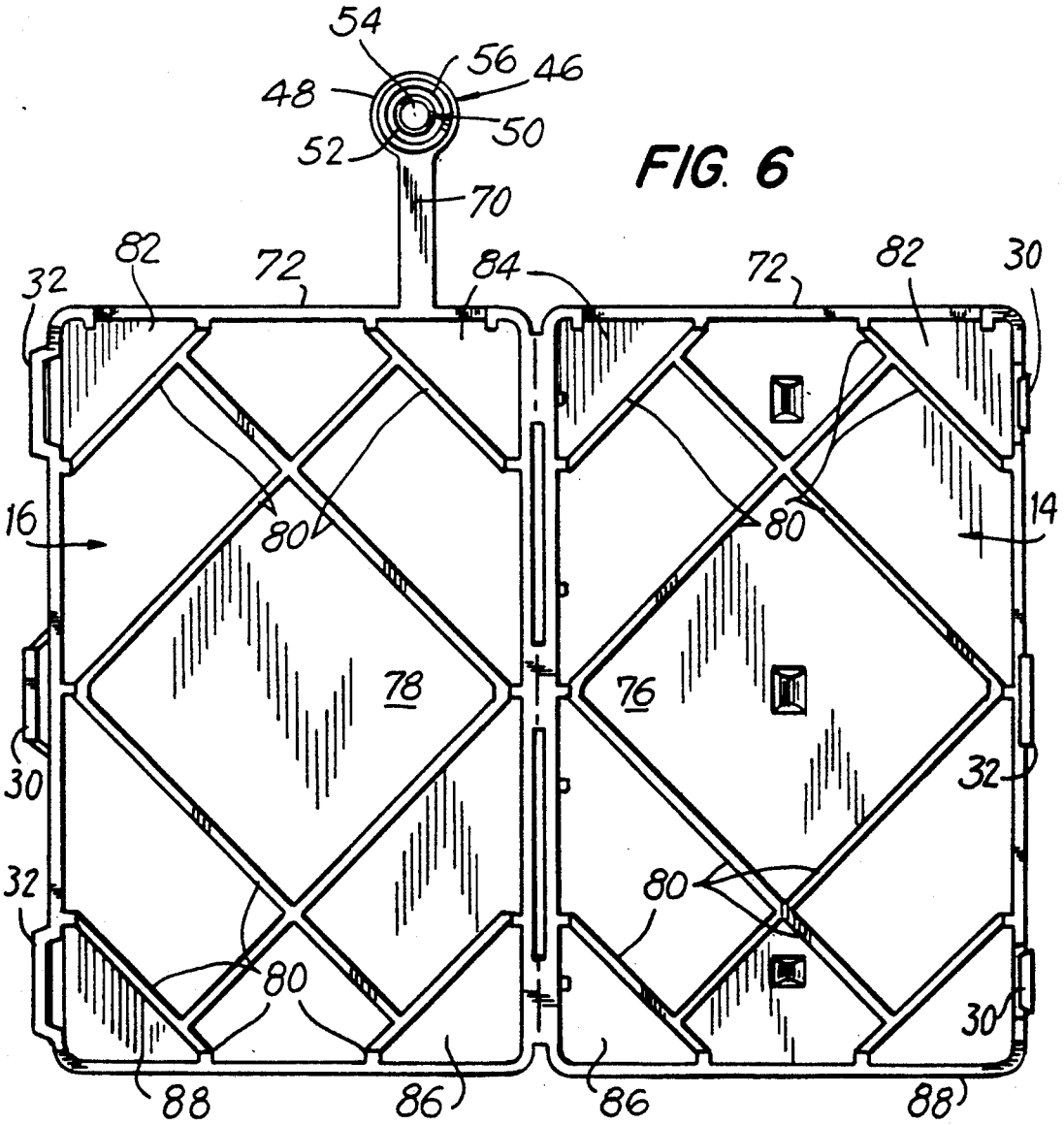
FIG. 6 is an elevational view looking into a fully opened housing.

As can be seen in FIGS. 1 and 3, housing portions 24 and 26 are locked or secured together in use by three (3) child resistant locks 28, one of which comprises a resilient, movable finger 30 extending in canterlever fashion from its respective housing portion to and over seam 22 until it is able to overlie a locking rib 32 formed adjacent seam 22 integral with the opposing housing portion. A ridge or locking tab 34 formed integral with and at the extremity of finger 30, when pressed toward and into contact with the said opposing housing portion, engages and is frictionally captured by its cooperative locking rib, thereby causing finger 30 to assume and resist its respective share of forces that would otherwise separate housing portions 24 and 26. There may also be provided two latches 31 (FIG. 6). At the end of each latch 31 may be a boss 33 (FIG. 33). Each latch 31 extends from its respective housing portion and across the seam 22. A catch 35 is formed in the opposing housing portion. Each latch 31 is inserted through its respective catch 35 and the boss 33 holds the housing together.

It is here worth emphasizing that variations of configurations of the present invention are possible without departing from the concept and spirit of the invention. Thus, while examples of the invention will be described herein, the reader is cautioned that my invention contemplates equivalent means for accomplishing the intended purposes of this invention. By way of example only, while three locks 28 have been described in the preferred embodiment, a single such lock may suffice—or two or more may be desirable. Similarly, while a living hinge 18 has been disclosed, the present invention contemplates housing 12 as being constructed of two completely separable halves which may be joined at the hinge seam 20 by a hook and loop or other configuration. Other variations will become apparent to one skilled in the art without departing from the spirit of my invention, and it is not believed necessary to burden the present specification with yet further examples.

Three (3) straw holders 36 are equally spaced along side 38 of housing half 14 and each consists of an integral raised boss 40 through which a hole 42 is formed. Holes 42 are of a diameter which will accommodate and receive the standard diameter drinking straw 44 shown in FIG. 1, with slight but sufficient frictional interference such that the straw 44 will not easily fall out, but which can be easily removed by a child or other user. Obviously, other numbers of straw holders 36 are possible, and in a preferred embodiment of this invention the lowermost boss 40 is formed with a bottom wall or shelf against which the straw end may rest and be stopped.

Figure 2:
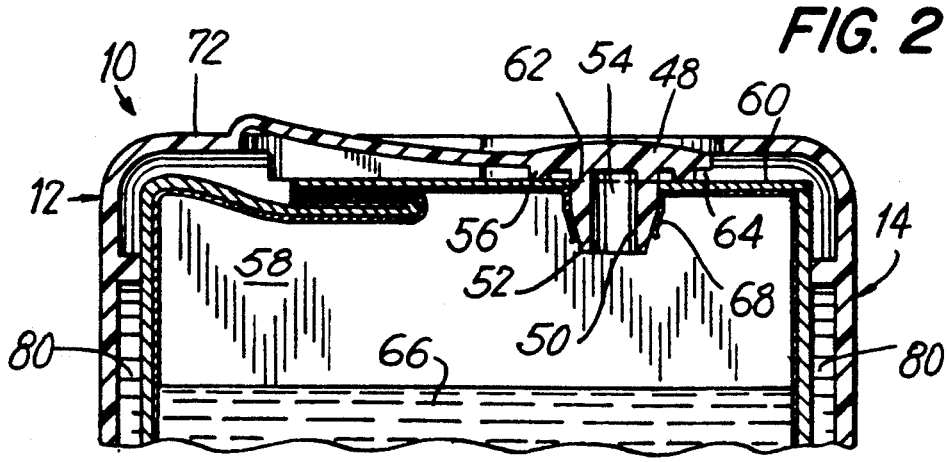
FIG. 2 is a sectional elevational view taken along the line 2—2 of FIG. 1.

A plug 46 is formed with a cap 48 beneath which a tube 50 extends toward its tapered end 52 A plug cavity 54 extends coaxially with respect to the axis of tube 50 from end 52 to the underside of cap 48. Cavity 54 is optional. A generally cylindrical rib 56 extends coaxially about and spaced from tube 50, and is integral at its upper extremity as shown in FIG. 2 with cap 48, and engages container 58 at its lower bearing surfaces 60. Rib 56 serves to distribute forces over the area of container 58 around its upper drinking straw hole 62, and also provides a gap 64 into which the user's fingernail may be inserted in an effort to lift and remove plug 46 and its tube 50 from straw hole 62. While not shown in great details in the drawings, normally juice box containers 58 are sold with a frangible foil film 68 which covers straw hole 62 and which may be pierced by the straw 44 in order to gain access to the fluid contents 66 of container 58.

Plug 46 is preferably joined to housing 12 by means of a connecting tab 70, which may be integrally molded to a housing half 16 at upper end 72 of housing 12. Upper end 72 is further formed with a generally central opening 74, which permits identification of the container 58 and which also permits access to straw opening 62 and placement of plug 46 into the opening. By making central opening 74 large enough to leave nearly the entire top of the container 58 exposed, the user is afforded an opportunity to access the straw hole in the container located in any number of different locations in the container top.

FIG. 6 illustrates housing 12 and its halves 14 and 16 fully opened such that the reader is facing the inner walls 76 and 78, respectively, of halves 14 and 16. A waffle-type pattern of crossing internal ribs 80 provides spaced bearing surfaces which serve to position and hold containers 58 within the confines of housing 12. FIGS. 2–5 illustrate the inwardly facing surfaces of ribs 80 in contact with the outer surfaces of containers 58. Recesses 82, 84, 86 and 88 which are defined by ribs 80 of the respective housing halves 14 and 16 accommodate the corners 90 of containers 58.

While not essential to the functioning of the present invention, it is contemplated that this invention be produced at relatively lower costs which will enable its use as a premium as well as being saleable indepeniently of products or services. Portions of housing 12 may be silk screened with indicia or may carry attachments such as stickers or labels. The housing may also be made in any number of a variety of colors and outer shapes.

The embodiments of the invention disclosed and described in the present specification and drawings and claims are presented merely as examples of the invention. Other embodiments, forms and modifications thereof will suggest themselves from a reading thereof and are contemplated as coming within the scope of the present invention.

What is claimed is:

1. A housing of the type capable of receiving a drink-containing flexible carton, the drink carton being substantially a parallelepiped and being of the type having a presealed pierceable opening in its top wall so dimensioned as to receive a straw or the like, said housing comprising:

a) bottom and opposed side wall means defining an interior space for receiving therein the drink carton with the carton top wall at the top of said housing;

b) top means in conjunction with at least one of said side walls and proximate the top wall of the carton; said top means comprising an opening for exposing at least a part of the top wall of the carton such that access may be gained to the straw opening in any number of different locations; and c) stopper means comprising an arm and a stopper; one end of said arm pivotally coupled to said top means; said stopper being selectively positionable so as to locate and move into and out of registry with the straw opening; said stopper means when in registry with the straw opening being insertable into the straw opening for substantially sealing the opening.

2. A housing as recited in claim 1 wherein said stopper means comprises a plug, a cap secured to said plug, and spacer means; said plug being so dimensioned as to be received in the carton hole; said spacer means providing a space between said cap and the carton top wall to facilitate removal of said stopper.

3. A housing as recited in claim 2 wherein said spacer means being so dimensioned as to enclose said plug and thereby close the carton hole upon said plug being in the carton hole.

4. A housing as recited in claim 2 wherein said spacer means comprises a wall integrally formed with said cap.

5. A housing as recited in claim 4 wherein said plug is substantially cylindrical; said spacer wall is substantially cylindrical, integrally formed with said cap and extends coaxially with and about said plug.

6. A housing as recited in claim 5 wherein side wall means are side walls which substantially enclose the respective proximate carton sides when a carton is placed in said housing.

7. A housing as recited in claim 1 further comprises means for retaining a straw.

8. A housing as recited in claim 5 further comprises means for retaining a straw.

9. A housing as recited in claim 1 wherein said top means comprises a top wall portion integrally formed with at least one of said side walls, extending over a part of the top, and extending substantially parallel said bottom wall and wherein said housing interior dimensions substantially conform to the outer dimensions of the carton; said stopper means being coupled to said top wall portion.

10. A housing as recited in claim 9 wherein said stopper comprises a plug, a cap secured to said plug; said plug being so dimensioned as to be received in the carton hole.

11. A housing as recited in claim 1 wherein said stopper arm is secured to said top means by means of a living hinge.

12. A housing as recited in claim 1 wherein there are four side walls; hinge means for hingedly connecting said side walls to admit or remove the carton.

13. A housing as recited in claim 12 wherein each of said side walls and said bottom wall comprise separate wall portions; hinge means connecting together at least one of said side walls so as to define a clam-shell enclosure for receiving the carton.

14. A housing as recited in claim 13 wherein said hinge means comprises a hinge and locking means; said hinge coupling said walls and said locking means securing said walls.

15. A housing as recited in claim 14 wherein said hinge extends along the length of one of said side walls between said bottom wall and said top wall.

16. A housing as recited in claim 15 wherein said locking means comprises latch means secured to a side wall and a catch secured to a mating side wall such than when closed, said latch engages said catch holding said housing releasably together.

17. A housing as recited in claim 10 further comprises means for retaining a straw.

18. A housing as recited in claim 16 further comprises means for retaining a straw.

19. A housing of the type capable of receiving a drink-containing flexible carton, the drink carton being substantially a parallelepiped and being of the type having a presealed pierceable opening in its top wall so dimensioned as to receive a straw or the like, said housing comprising:

a) bottom and opposed side wall means defining an interior space for receiving therein the drink carton with the carton top wall at the top of said housing;

b) top means in conjunction with at least one of said side walls and proximate the top wall of the carton; said top means comprising an opening for exposing at least a part of the top wall of the carton such that access may be gained to the straw opening in any number of different locations; and c) stopper means comprising an arm and a stopper; one end of said arm pivotally coupled to said top of said side wall means; said stopper being selectively positionable so as to locate the move into and out of registry with the straw opening; said stopper means when in registry with the straw opening being insertable into the straw opening for substantially sealing the opening.

20. A housing as recited in claim 19 wherein said top of said side wall means extending over at least a part of the top of the carton when the carton is in said housing and wherein said housing interior dimensions substantially conform to the outer dimensions of the carton; said arm is coupled to one of said extending side wall.

21. A housing as recited in claim 20 wherein said stopper comprises a plug, a cap secured to said plug; said plug being so dimensioned as to be received in the carton hole.

* * * * *